United States Patent [19]

Takahashi et al.

[11] 4,243,839

[45] Jan. 6, 1981

[54] TRANSDUCER WITH FLUX SENSING COILS

[75] Inventors: Kenichi Takahashi; Tatsuo Fukuyama, both of Kyoto; Takafumi Ueno, Moriguchi; Yasuomi Shimada, Hirakata; Shinichiro Ishii, Neyagawa, all of Japan

[73] Assignee: Matsushita Electric Industrial Co., Ltd., Osaka, Japan

[21] Appl. No.: 968,679

[22] Filed: Dec. 12, 1978

[30] Foreign Application Priority Data

Dec. 14, 1977 [JP] Japan ..... 52-150799
Dec. 14, 1977 [JP] Japan ..... 52-150800

[51] Int. Cl.[3] ..... H04R 9/06
[52] U.S. Cl. ..... 179/1 F; 179/115.5 R
[58] Field of Search ..... 179/1 F, 115.5 DV, 115.5 R

[56] References Cited

U.S. PATENT DOCUMENTS 3,798,374 3/1974 Meyers ..... 179/1 F

FOREIGN PATENT DOCUMENTS 2658528 6/1978 Fed. Rep. of Germany ..... 179/1 F

*Primary Examiner*—James W. Moffitt
*Attorney, Agent, or Firm*—Spencer & Kaye

[57] ABSTRACT

A transducer such as used for an electro-dynamic loudspeaker adapted to convert an electric signal into a mechanical motion or, a moving coil type velocity sensor adapted to convert a mechanical motion into an electric signal. The so-called "Bl force factor," representative of the product of the magnetic flux density B and the length l of the main coil, is so controlled as to be made constant, whereby the linearity of the transducer is improved.

14 Claims, 18 Drawing Figures

TRANSDUCER WITH FLUX SENSING COILS

BACKGROUND OF THE INVENTION

Generally, it has been known that, in a loudspeaker system, the harmonic distortion at lower frequencies results from the non-linearity of the enclosure spider and like elements involved in the mechanical system and that the harmonic distortion at higher frequencies is due to Bl distortion and current distortion. In order to reduce the latter distortion, that is, the Bl distortion and current distortion, various approaches have conventionally been proposed including the following typical measures:

(i) A member composed of a material having a low hysteresis, for example a laminated core, is arranged near an air-gap defined by the pole piece and the plate of the loudspeaker is selected. This improves the non-linearity of the voice coil impedance and reduces the current distortion.

(ii) The pole piece is capped with a copper cylinder to cancel the magnetic flux generated by the voice coil.

(iii) A copper ring or similar member is placed so that the magnetic flux of the magnetic circuit passes through the ring in order to cancel the magnetic flux generated by the voice coil.

However, these conventional measures for reducing the harmonic distortion are, so to speak, passive ones in which their effect in reducing the distortion is restricted by the magnitude of the conductivity and hysteresis of the material and are disadvantageous in that the reduction of harmonic distortion cannot be attained at will. Turning to a conventional moving coil type velocity sensor, it has a driving assembly which consists of a magnetic circuit, a velocity sensing coil and a spider, and therefore resembles the driving assembly of the electro-dynamic loudspeaker. Consequently, it suffers from harmonic distortion which is similar to that exhibited by the electro-dynamic loudspeaker. The harmonic distortion exhibited by the moving coil type velocity sensor mainly results from the fact that the magnetic flux density across the velocity sensing coil corresponding to the voice coil of the loudspeaker changes as the velocity sensing coil moves. In order to eliminate the change in the magnetic flux density, it is necessary to increase the width of the velocity sensing coil or make the thickness of the plate larger than the width of the coil, resulting in the additional disadvantage that the size of the magnet is increased together with an increase in the size and weight of the sensor itself.

SUMMARY OF THE INVENTION

This invention contemplates elimination of aforementioned conventional drawbacks and provides an improved transducer which is improved in its linearity by an active, electric feedback control, whereby when used as an electro-dynamic loudspeaker, the transducer can reduce the harmonic distortion associated with its driving assembly and when used as a moving coil type velocity sensor, transducer can reduce the distortion in velocity detection.

DESCRIPTION OF THE PREFERRED EMBODIMENTS

Figure 1:
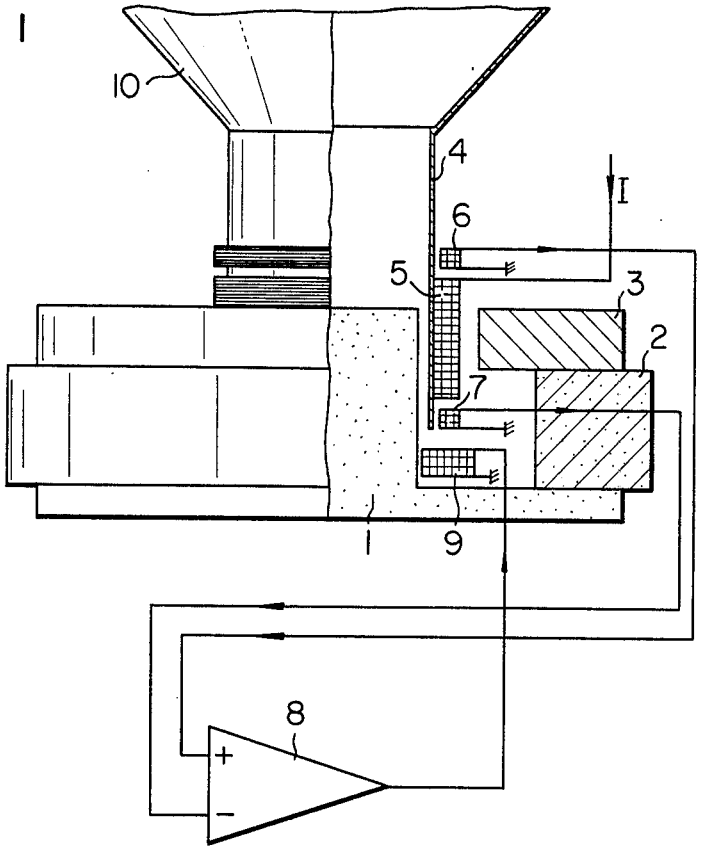
FIG. 1 is a diagrammatic representation, partly in section, showing one embodiment of the invention as applied to an electro-dynamic loudspeaker.

Referring now to FIG. 1, there is shown an electro-dynamic loudspeaker, to which the invention is applied, comprising a pole piece 1, a magnet 2, a plate 3, a voice coil former or bobbin 4 inserted in an air-gap between the pole piece 1 and the plate 3, a voice coil 5 wound about the voice coil former 4 to act as a main coil, an upper magnetic flux sensing coil 6, a lower magnetic flux sensing coil 7, an amplifier 8 with integral function, a feedback coil 9, and a diaphragm 10 connected to the voice coil former 4.

A qualitative operational description will first be given of the embodiment of FIG. 1. When a current I is passed through the voice coil 5, the voice coil 5 is driven between the pole piece 1 and the plate 3 in the axial direction, that is, in the vertical direction as viewed from FIG. 1, causing the diaphragm 10 connected to the voice coil former to be driven. Then, the upper and lower magnetic flux sensing coils 6 and 7 respectively detect magnetic flux across the upper and lower ends of the voice coil 5, and induced electromotive forces or output currents induced thereby are supplied to positive and negative input terminals of the amplifier 8, respectively. The amplifier 8 amplifies a difference between the input voltages or the input currents and delivers an output which in turn is applied to the feedback coil 9. On the assumption that the amplifier 8 has a sufficiently large gain, a current may be passed from amplifier 8 to feedback coil 9, which current cancels the difference between the induced electromotive forces or output currents induced thereby in the upper and lower magnetic flux sensing coils 6 and 7. As a result, the controlling action maintains the total magnetic flux across the voice coil 5 constant. A force f acting on the voice coil 5, which is based on interaction between current and magnetic field, is given by $$f = \bar{B}Il$$

where $\overline{B}$ represents the mean flux density across the voice coil 5 and l the length of the voice coil 5. Since the mean flux density $\overline{B}$ is made constant by the aforementioned controlling action, the force f is directly proportional to the current I.

Figure 2:
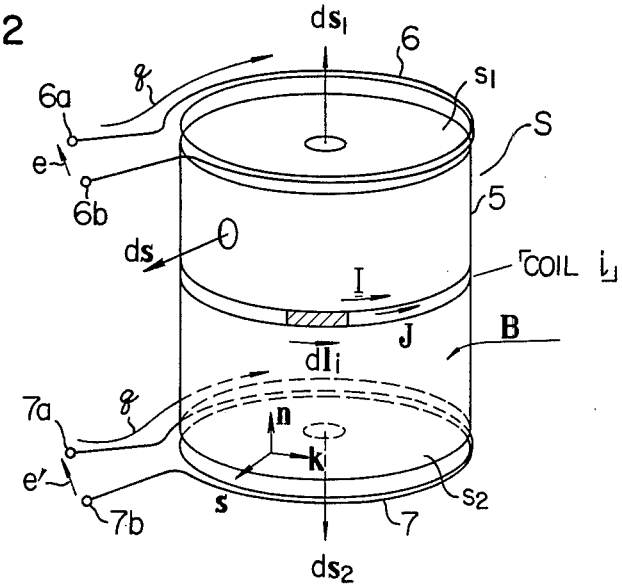
FIG. 2 is a perspective view of an assemblage of coils useful in explaining the operation of the embodiment shown in FIG. 1.

The operation has been outlined qualitatively hereinbefore. Next, a strict, operational description will be given with reference to FIGS. 2 and 3. FIG. 2 illustrates a three-dimensional view of an assemblage of the voice coil 5 and the upper and lower magnetic flux sensing coils 6 and 7 of the embodiment shown in FIG. 1. In the figure, ds designates an area element of a surface S about which the voice coil 5 is wound, and I the current flowing through the voice coil 5 whose forward direction is defined by the arrow. "Coil i" represents the i-th turn of the voice coil, and a vector $\underline{J}$ represents the current density which is distributed uniformly through the cross-section of the voice coil 5. The symbol $d\underline{l}_i$ designates a vector line element of the "Coil i", $d\underline{s}_1$ a vector area element of the upper end surface $s_1$ of the voice coil, $d\underline{s}_2$ a vector area element of the lower end surface $s_2$ of the voice coil, $\underline{s}$ a normal unit vector of the surface S about which the voice coil 5 is wound, $\underline{n}$ an axial unit vector of the voice coil 5, and k a tangential unit vector of the voice coil winding whose forward direction is identified as the direction of the current I. The upper and lower magnetic flux sensing coils 6 and 7 respectively located around the upper and lower ends of the voice coil 5 are wound in the direction designated by the arrows q and have the same number of turns. This assumption does not impair the general nature of the discussion. Respective voltages e and e' across the upper and lower magnetic flux sensing coils 6 and 7 are measured at terminals 6*a* and 7*a* with respect to terminals 6*b* and 7*b*. A vector $\underline{B}$ designates the flux density in the voice coil.

Figure 3:
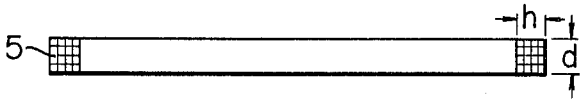
FIG. 3 is a sectional view of a part of a main coil of the assemblage shown in FIG. 2.

FIG. 3 shows a fragmentary section of the voice coil 5, in which h and d designate the height and width of the voice coil 5 respectively. The section is herein assumed to be of a rectangular configuration but the general nature of the discussion is not impaired by this assumption.

A vector $\underline{F}$ representative of a force acting on the voice coil 5 can be expressed in the general form of a volume integral of the product of the current density $\underline{J}$ and flux density $\underline{B}$ at a location where the current flows and is written as $$F=\int(J\times B)dv \quad (1),$$

where dv represents a volume element. Because of the assumption that the current flows uniformly through the cross-section of the coil, the volume integral may be calculated within a space occupied by the voice coil winding The volume element dv is $$dv=h\cdot ds \quad (2)$$

and equation (1) reduces to, $$F=h\int(\underline{J}\times\underline{B})ds \quad (3)$$

The direction of current density $\underline{J}$ is identical with that of vector $\underline{k}$ and accordingly, equation (3) reduces to, $$\underline{F}=hJ\int(\underline{k}\times\underline{B})ds \quad (4)$$

where $J=|\underline{J}|$.

The controlling operation as explained with reference to FIG. 1 which is employed for cancelling the difference between electromotive forces e and e' of the upper and lower magnetic flux sensing coils 6 and 7 can be expressed in the form of a mathematical formula as follows. From Faraday's law, electromotive forces e and e' are first given by the form, $$e=(d/dt)(\int\underline{B}\cdot d\underline{s}_1);$$

$$e'=-(d/dt)(\int\underline{B}\cdot d\underline{s}_2). \quad (5)$$

where the second formula is assigned a minus sign because the directions of vectors $\underline{s}_1$ and $\underline{s}_2$ are opposite to each other. Since the control as explained in FIG. 1 cancels the difference between e and e', the formulae in equation (5) are combined, reducing to $$(d/dt)(\int\underline{B}\cdot d\underline{s}_1+\int\underline{B}\cdot d\underline{s}_2)=0. \quad (6)$$

Incidentally, the flux density $\underline{B}$ has no source and hence the surface integral of the flux density $\underline{B}$ along a closed surface is always zero. Based on this characteristic, the surface integral of the flux density $\underline{B}$ along a closed surface defined by $\underline{s}_1$, $\underline{s}_2$ and S is, $$\int\underline{B}\cdot(d\underline{s}_1+d\underline{s}_2+d\underline{s})=0 \quad (7)$$

where $d\underline{s}=\underline{s}ds$

By combining equation (7) with equation (6), $$(d/dt\int\underline{B}\cdot d\underline{s}=0 \quad (8)$$

is obtained which in turn is integrated to obtain $$\int\underline{B}\cdot d\underline{s}=\Phi_o \quad (9)$$

Equation (9) corresponds to a mathematical expression of the controlling action explained with reference to FIG. 1 and proves that the total flux across the surface S about which the voice coil is wound is made constant.

Under this condition, a force acting on the voice coil 5 will be discussed hereinafter. In accordance with the definition of the vectors $\underline{n}$ and $\underline{k}$, a unit vector s is first written as $$s=\underline{k}\times\underline{n} \quad (10).$$

From equation (10), equation (9) is reduced to, $$\int\underline{B}\cdot d\underline{s}=\int\underline{B}\cdot\underline{s}ds=\int\underline{B}\cdot(\underline{k}\times\underline{n})ds$$

and the last term satisfies $$\int\underline{B}\cdot(\underline{k}\times\underline{n})ds=-\int\underline{k}\times\underline{B})\cdot\underline{n}ds$$

so that $$\Phi_o=-\int(\underline{k}\times\underline{B})\cdot\underline{n}ds \quad (11)$$

can be obtained.

On the other hand, the force $\underline{F}$ acting on the voice coil 5 as written in equation (4), that is, $$\underline{F}=hJ\int(\underline{k}\times\underline{B})ds$$

is combined with equation (11), reducing to $$\underline{F}\underline{n}=-hj\Phi_o \quad (12).$$

As defined in equation (9), $\Phi_o$ represents the total flux across the surface s about which the voice coil 5 is wound and by using a mean flux density $B_o$ on the surface S, it is expressed by, $$\Phi_o = B_o S \quad (13)$$

where s represents the area of the surface about which the voice coil 5 is wound, which area is $$S = ld \quad (14)$$

where l represents the total length of the voice coil.

Further, a relation as expressed by, $$I = J \times (h \times d) \quad (15)$$

exists between the magnitude J of the current density and the current I. By combining equations (13), (14) and (15) with equation (12), it follows that $$\underline{F} \cdot \underline{n} = -B_o \cdot l \cdot I; \quad (16).$$

Equation (16) indicates that as a result of the controlling operation as explained with reference to FIG. 1, the force $\underline{F} \cdot \underline{n}$ acting in the axial direction of voice coil 5 represented by vector $\underline{n}$ is correctly proportional to the current I flowing through the voice coil 5 and proves that the invention is effective in reducing harmonic distortion. Needless to say, $B_o$ and l in equation (16) are constants as is seen from their definition.

As is seen from the foregoing description with reference to FIGS. 2 and 3, it is possible to make the force generated in the voice coil directly proportional to the voice coil current I by means of the controlling operation which cancels the difference between the voltages of the upper and lower magnetic flux sensing coils 6 and 7.

In realizing the controlling action for cancelling the difference in voltage or current between the magnetic flux sensing coils 6 and 7 as explained with reference to FIG. 1, the negative feedback technique may be employed to attain a sufficient feedback control since the circuit of FIG. 1 which establishes a loop through amplifier 8, feedback coil 9 and upper and lower magnetic flux sensing coils 6 and 7 has an ordinary loop gain and hence operates as a minimal phase shift circuit. It should be appreciated that the controlling action for cancelling the difference in voltage between the upper and lower magnetic flux sensing coils 6 and 7 is essentially identical with the controlling action for cancelling the difference in current between these sensing coils 6 and 7. Therefore, the invention is useful for cancelling the current difference when the input impedance of the amplifier 8 is very low and cancelling the voltage difference when the input impedance of the amplifier 8 is high.

Further, it should be understood from the foregoing description that if the driving assembly with the electric feedback controlling ability according to the invention is driven by a so-called constant current amplifier which is free from any current distortion irrespective of loading, the force generated by the driving assembly can be completely freed from harmonic distortion and it is possible to construct a much more distortion-free loudspeaker system.

Turning to FIGS. 4 to 7, the mounting of the upper and lower magnetic flux sensing coils 6 and 7 will specifically be described.

Figure 4:
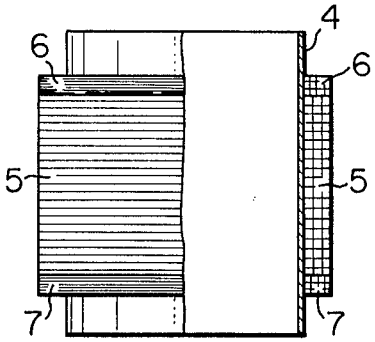
FIG. 4 is a partially sectional view showing a disposition of magnetic flux sensing coils.

In FIG. 4 there are shown upper and lower magnetic flux sensing coils 6 and 7 which are respectively wound in intimate contact with the upper and lower ends of the voice coil 5. With this construction, in the event that the voice coil 5 vibrates with a large amplitude, the magnetic flux sensing coils 6 and 7 can move along with the voice coil 5, thereby ensuring correct detection of the flux across the upper and lower end surfaces of the voice coil 5.

Figure 5:
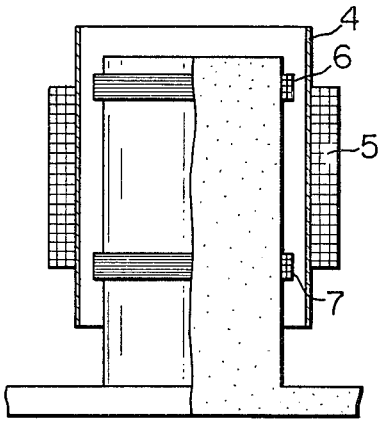
FIG. 5 is a partially sectional view showing coils.
Figure 6:
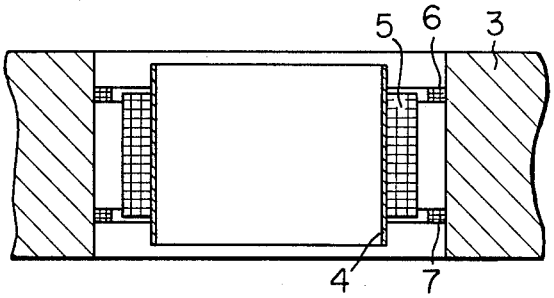
FIG. 6 is a sectional view showing another disposition of magnetic flux sensing coils.

Conversely, in an application where the vibratory amplitude of the voice coil 5 is small, for example, in the case of a tweeter, it is not always necessary to wind the magnetic flux sensing coils 6 and 7 in intimate contact with the voice coil 5. Rather, the magnetic flux sensing coils 6 and 7 may be wound on the pole piece 1 to oppose the upper and lower ends of the voice coil as shown in FIG. 5 or, alternatively, for the same reason, the windings of the magnetic sensing coils 6 and 7 may abut against the plate 3 to oppose the upper and lower ends of the voice coil as shown in FIG. 6. With these embodiments, similar effects can be obtained.

Figure 7:
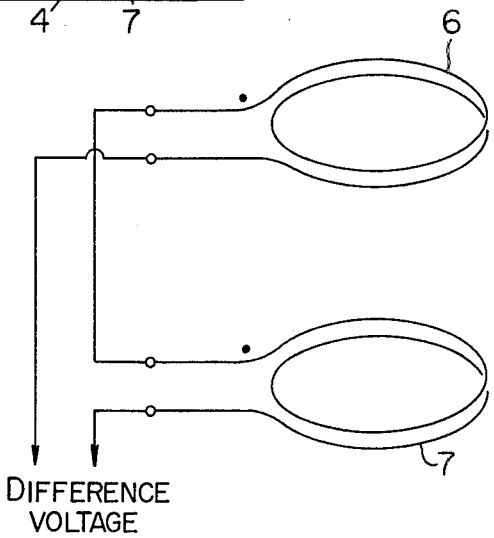
FIG. 7 is a connection diagram of magnetic flux sensing doils connected to pick up the difference voltage.

In a modification as shown in FIG. 7, the upper magnetic flux sensing coil 6 and the lower magnetic flux sensing coil 7 are connected to each other in the opposite polarity relationship, thereby permitting the difference voltage to be picked up. The number of turns of the winding of the upper magnetic flux sensing coil 6 is made equal to that of the lower magnetic flux sensing coil 7, thus making it possible to obtain the difference voltage proportional to the difference in flux across both the coils 6 and 7.

Figure 8A:
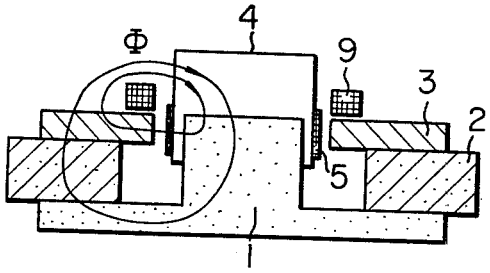
FIGS. 8A, 8B, 8C and FIG. 9 are sectional views showing different dispositions of a feedback coil.
Figure 8B:
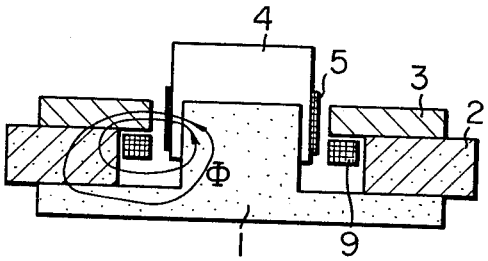
Figure 8C:
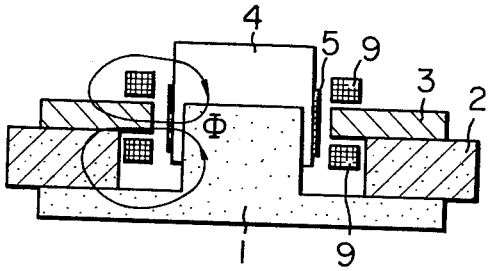

Various ways of mounting the feedback coil 9 are specifically shown in FIGS. 8A, 8B and 8C which illustrate dispositions of the feedback coil 9 above, underneath, and above and under the plate 3, respectively. In each disposition, a magnetic field generated by the feedback coil 9 intersects the surface about which the voice coil 5 is wound and accordingly, the feedback coil can perform its function.

Figure 9:
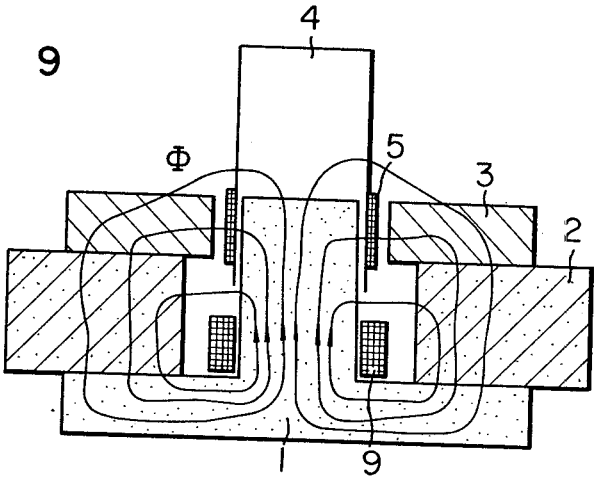

FIG. 9 shows a modified embodiment wherein the feedback coil 9 is disposed immediately above a base portion of the pole piece 1. In this case, too, the feedback coil can perform its function since the magnetic field generated by the feedback coil 9 intersects the surface about which the voice coil 5 is wound.

As described above, in the foregoing embodiment and modifications, the upper and lower magnetic flux sensing coils are provided for detecting the flux across the upper and lower ends of the voice coil and the difference in output voltage or output current between these magnetic flux sensing coils is applied through the amplifier to the feedback coil separately disposed in the magnetic circuit to make constant the Bl force factor of the driving assembly, whereby the harmonic distortion due to Bl distortion and current distortion can be reduced remarkably. If the voice coil itself is driven by a so-called constant current amplifier which is free from any current distortion irrespective of loading, the force generated by the driving assembly can be completely freed from harmonic distortion, thus making it possible to provide a much more distortion-free loudspeaker system.

Figure 10:
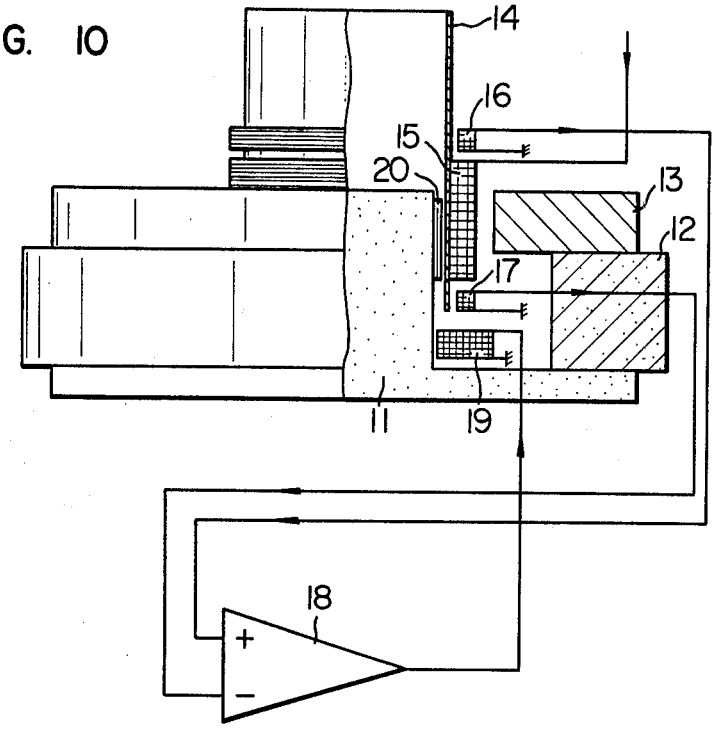
FIG. 10 is a diagrammatic representation, partly in section, showing another embodiment of the invention as applied to a moving coil type velocity sensor.

Turning now to FIG. 10, there is shown a moving coil type velocity sensor, to which the invertion is applied, comprising a pole piece 11, a magnet 12, a plate 13, a bobbin 14 inserted in an air-gap between the pole piece 11 and the plate 13, a velocity sensing coil 15 wound about the bobbin 14 to act as a main coil, an upper magnetic flux sensing coil 16, a lower magnetic flux sensing coil 17, an amplifier 18 with integral function, a feedback coil 19, and a compensating coil 20.

A qualitative operational description will first be given of the embodiment shown in FIG. 10. When applied a force is applied, the velocity sensing coil 15 is driven between the pole piece 11 and the plate 13 in the axial direction, that is, in the vertical direction as viewed in FIG. 10. Then, the upper and lower magnetic flux sensing coils 16 and 17 respectively detect flux across the upper and lower ends of the velocity sensing coil 15, and induced electromotive forces or output current induced thereby are supplied to positive and negative input terminals of the amplifier 18, respectively. The amplifier 18 amplifies the difference between the input voltages or input currents and delivers an output which in turn is applied to the feedback coil 19. On the assumption that the amplifier 18 has a sufficiently large gain, a current may be passed from amplifier 18 to feedback coil 19, which current cancels the difference between the induced electromotive forces or output currents induced thereby in the upper and lower magnetic flux sensing coils 16 and 17. As a result, the controlling action maintains the total magnetic flux across the velocity sensing coil 15 constant. An electromotive force E generated in the velocity sensing coil 15, which is based on electromagnetic induction, is given by, $$E=\overline{B}\cdot l\cdot u$$

where $\overline{B}$ represents the mean flux density across the velocity sensing coil 15, l the length of the velocity sensing coil, and u the axial velocity of the velocity sensing coil 15. Since the mean flux density $\overline{B}$ is made constant by the aformentioned controlling action, the electromotive force E is directly porportional to the velocity u. Accordingly, by measuring the difference in outpt voltage between the velocity sensing coil 15 and the compensation coil 20 under this proportional condition, it is possible to correctly detect the velocity of the velocity sensing coil 15, that is, the moving velocity of the bobbin 14.

The operation has been outlined qualitatively hereinbefore. Next, a strict, operational description will be given with reference to FIG. 11 which illustrates a three-dimensional view of an assemblage of the velocity sensing coil 15 and the upper and lower magnetic flux sensing coils 16 and 17 of the emobidment shown in FIG. 11. In this figure ds designates an area element of a surface S about which the velocity sensing coil is wound, and u the axial velocity of the velocity sensing coil. "Coil i" represents the i-th turn of the velocity sensing coil, $dl_i$ a vector line element of the "Coil i", $d\underline{s}_1$ a vector area element of the upper end surface $s_1$ of the velocity sensing coil, $d\underline{s}_2$ a vector area element of the lower end surface $s_2$ of the velocity sensing coil, $\underline{s}$ a normal unit vector of the surface s about which the velocity sensing coil 15 is wound, $\underline{n}$ an axial unit vector of the velocity sensing coil, and $\underline{k}$ a tangential unit vector of the velocity sensing coil winding. The upper and lower magnetic flux sensing coils 16 and 17 respectively located around the upper and lower ends of the velocity sensing coil are wound in the direction designated by arrow q, and have the same number of turns. This assumption does not impair the general nature of the discussion. Respective voltages e and e' across the upper and lower magnetic flux sensing coils 16 and 17 are measured at terminals 16*a* and 17*a* with respect to terminals 16*b* and 17*b*. A vector $\underline{B}$ designates the flux density.

Figure 12:
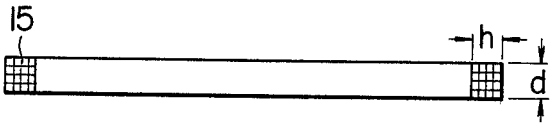
FIG. 12 is a sectional view of a part of a main coil of the assemblage shown in FIG. 11.

FIG. 12 shows a fragmentary section of the velocity sensing coil 15, in which h and d designate the height and width of the velocity sensing coil. The section is herein assumed to be of a rectangular configuration but the general nature of the discussion is not impaired by the assumption.

Incidentally, the controlling operation as explained with reference to the FIG. 10 embodiment which is employed for cancelling the difference between electromotive forces e and e' of the coils 16 and 17 can be expressed in the form of a mathematical formula as follows. From Faraday's low, electromotive forces e and e' are first expressed by the form, $$e=(d/dt)(\int \underline{B}\cdot d\underline{s}_1)$$

$$e'=(d/dt)(\int \underline{B}\cdot d\underline{s}_2) \quad (17)$$

where the second formula is assigned a minus sign because the directions of vectors $\underline{s}_1$ and $\underline{s}_2$ are opposite to each other. Since the control as explained in FIG. 10 cancels the difference between e and e', the formulae in equation (17) are combined, to reducing $$(d/dt)(\int \underline{B}\cdot d\underline{s}_1+\int \underline{B}\cdot d\underline{s}_2)=0 \quad (18).$$

Incidentally, the flux density $\underline{B}$ has no source and hence the surface integral of the flux density $\underline{B}$ along a closed surface is always zero. Based on this characteristic, the surface integral of the flux density $\underline{B}$ along a closed surface defined by $\underline{s}_1$, $\underline{s}_2$ and S becomes $$\int \underline{B}\cdot(d\underline{s}_1+d\underline{s}_2+d\underline{s})=0 \quad (19)$$

where $d\underline{s}=\underline{s}\cdot ds$

By combining equation (19) with equation (18), $$(d/dt)\int \underline{B}\cdot d\underline{s}=0 \quad (20)$$

is obtained which in turn is integrated to obtain $$\int \underline{B}\cdot d\underline{s}=\Phi_0 \quad (21)$$

Equation (21) corresponds to a mathematical expression of the controlling action as explained with reference to FIG. 10 and proves that the total flux across the surface S about which the velocity sensing coil is wound is made constant.

In realizing the controlling action for cancelling the difference in voltage or current between the magnetic flux sensing coils 16 and 17 as explained with reference to FIG. 10, the negative feedback technique, as in, the case of the aforementioned electo-dynamic loudspeaker may also be employed to attain a sufficient feedback control since the circuit of FIG. 10 which establishes a loop through amplifier 18, feedback coil 19 and magnetic flux sensing coils 16 and 17 has an ordinary loop gain and hence operates as a minimum phase shift circuit. It should be appreciated that the controlling action for cancelling the difference in voltage between the magnetic flux sensing coils 16 and 17 is essentially identical with the controlling for cancelling the difference in current between these sensing coils. Therefore, the invention is useful for cancelling the current difference when the input impedance of the amplifier 18 is very low and used cancelling the voltage difference used when the input impedance of the amplifier 18 is high.

Figure 11:
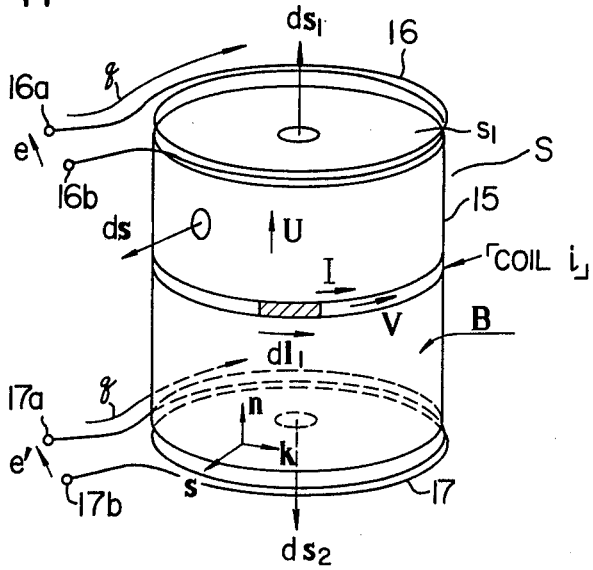
FIG. 11 is a perspective view of an assemblage of coils useful in explaining the operation of the embodiment shown in FIG. 10.

Now, a discussion will be directed to the electromotive force which is generated in response to the axial movement of the velocity sensing coil 15 under the controlling action explained with reference to FIG. 10 which always satisfies equation (21). Referring to FIG. 11, an electromotive force $e_i$ generated in "Coil i" is $$e_i = \Phi \underline{E}' \cdot d\underline{l}_i = -\int (\partial b/\partial a) + rot\,(\underline{B} \times \underline{u}) \cdot d\underline{s}_i \quad (22)$$

where $\underline{E}'$ represent the electric field strength generated in the winding of "Coil i", $\underline{u}$ the velocity of the movement of the velocity sensing coil, and $d\underline{s}_i$ a vector area element of the surface bounded by the "Coil i". The second term of the integrand in equation (22) is modified pursuant to Stokes' low as follows:

$$\int rot\,(\underline{B} \times \underline{u})\, d\underline{s}_i = \Phi(\underline{B} \times \underline{u})\, d\underline{l}_i = \Phi \underline{B}(\underline{u} \times d\underline{l}_i) \quad (23).$$

From the definition of vectors $\underline{n}$ and $\underline{k}$, it follows that, $$\left.\begin{array}{ll} u = un & u = |u| \\ dl_i = k\, dl_i & dl_i = |dl_i| \end{array}\right\} \quad (24)$$

Then, by combining equation (23) with equation (24), the second term of the integrand in equation (23) is modified into, $$-\Phi(\underline{B} \times \underline{u}) \times d\underline{l}_i = -\Phi \underline{B}(\underline{n} \times \underline{k}) u dl_i \quad (25)$$

Incidentally, "Coil i" occupies an area element (d·dli), identified as dsi herein, on the surface S about which the velocity sensing coil 15 is wound and equation (22) is combined with equation (25) by using dsi so that the electromotive force ei generated in "Coil i" may be written as, $$e_i = -\int (\partial B/\partial t) d\underline{s}_i - \int \underline{B}\,(\underline{n} \times \underline{k}) ds_i (u/d) \quad (26).$$

Thus, by totalizing the electromotive forces generated in all of the windings of the velocity sensing coil 15 respectively generating the electromotive force ei, the electromotive force E generated in the velocity sensing coil 15 becomes $$E = \Sigma e_i = -(\Sigma \partial \underline{B}/\partial t) ds_i - \int \underline{B}(\underline{n} \times \underline{k}) ds (u/d) \quad (27)$$

where ds represents an area element of the surface S about which the velocity sensing coil 15 is wound.

Under the controlling operation as explained with reference to FIG. 10, equation (21) becomes $$\phi_o = \int \underline{B} d\underline{s} = -\int \underline{B}(\underline{n} \times \underline{k}) ds \quad (28)$$

(by definition, $d\underline{s} = \underline{s} ds$, and $\underline{s} = \underline{k} \times \underline{n}$ holes. By combining equation (28) with equation (27), $$E = -\Sigma \int (\partial \underline{B}/\partial t) d\underline{s}_i + \Phi_o (u/d) = \Sigma \int (\partial \underline{B}/\partial t) \quad (29)$$

results. Then, by using the mean magnetic flux density $B_o$ which is defined as $\Phi_o = B_o \cdot S$ and taking $S = l \cdot d$ into consideration, equation (29) is further modified into $$E = -\Sigma \int (\partial \underline{B}/\partial t) d\underline{s}_i + B_o \cdot l \cdot u \quad (30).$$

Equation (30) indicates that the electromotive force generated in the velocity sensing coil 15 is a sum of the voltage of $B_o \cdot l \cdot u$ which is directly proportional to the axial velocity of the velocity sensing coil 15 and an induced voltage of $$-\Sigma \int (\partial \underline{B}/\partial t) d\underline{s}_i \quad (31)$$

which is generated on the assumption that the velocity sensing coil 15 is held in its original position. Since it is possible to pick up the induced voltage given in equation (31) independently by means of a stationary coil wound near the velocity sensing coil 15, a voltage proportional to the sensing coil velocity u can be obtained by substracting the induced voltage from the electromotive force E generated in the velocity sensing coil 15.

As described above, under the controlling operation explained with reference to FIG. 10, it is possible to pick up a voltage proportional to the velocity of the velocity sensing coil 15 from the electromotive force generated in the velocity sensing coil, thereby ensuring that the velocity of the velocity sensing coil can be detected without distortion.

Figure 13:
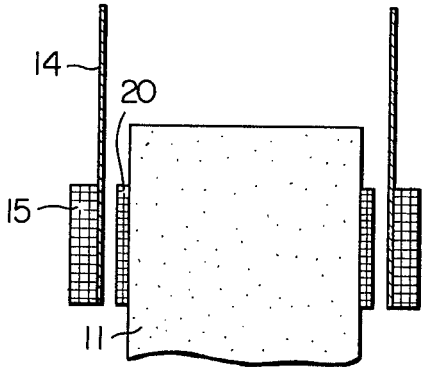
FIGS. 13 to 15 are fragmentary views, in section, showing different modifications of the embodiment shown in FIG. 10.

The compensating coil 20 is used to detect and cancel the induced voltage given in equation (31), which is contained in the electromotive force generated in the velocity sensing coil, and is disposed and wound as shown in FIG. 13. The winding of the compensating coil 20 has the same width as that of the velocity sensing coil 15 and opposes the winding of the velocity sensing coil 15 held in its original position. With this arrangement, unless the velocity sensing coil 15 vibrates with an excessively large amplitude, the induced voltage of the compensating coil 20 can have the same magnitude as that of the velocity sensing coil 15.

Figure 14:
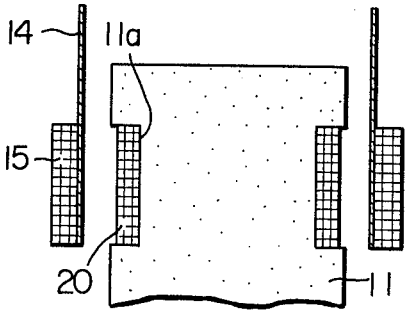

FIG. 14 shows a modified disposition of the compensating coil 20 in which the winding of the compensating coil 20 is received in an annular recess 11*a* formed in the outer periphery of the pole piece 11. Usually, the pole piece 11 is centered with respect to the velocity sensing coil 15 by means of a spacer not shown. This modified embodiment is advantageously compatible with the conventional way of centering because the winding of the compensating coil 20 received in the recess 11*a* can be governed so as to be flush, at the most, with the outer peripheral surface of the pole piece 11.

Figure 15:
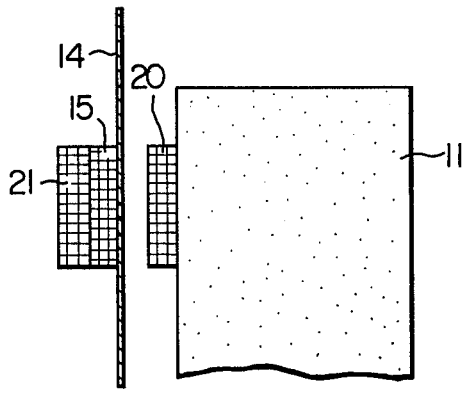

FIG. 15 shows a further modified embodiment which is based on the foregoing clear knowledge that driving assemblies of the moving coil type velocity sensor and the electro-dynamic loudspeaker have the same construction. Thus, the velocity sensing coil 15 is first wound about the bobbin 14 and the winding of a voice coil 21 is then superimposed on the velocity sensing coil 15 with the same width to provide a unitary distortion-free mechano-electric and electro-mechanical transducer.

Furthermore, it should be understood from the foregoing description that if a driving assembly with the electric feedback controlling ability according to the invertion is driven by an amplifier which is free from any current distortion irrespective of loading, that is, by a constant current amplifier, the force generated in the driving assembly can be completely freed from harmonic distortion and it is possible to construct a much more distortion-free velocity sensor.

As described above, in the foregoing embodiment and modifications as explained with reference to FIGS. 10 to 15, the upper and lower magnetic flux sensing coils are provided for detecting the flux across the upper and lower ends of the velocity sensing coil, the difference in output voltage or output current between these magnetic flux sensing coils is applied through the amplifier to the feedback coil separately disposed in the magnetic circuit to make constant the Bl force factor of the driving assembly, and the difference in output voltage between the velocity sensing coil and compensating coil is then picked up to detect the velocity of the velocity sensing coil, whereby the harmonic distortion due to magnetic distortion and current distortion can be reduced remarkably and the velocity of the velocity sensing coil can be detected with high accuracy. If, like the voice coil in the electro-dynamic loudspeaker, the velocity sensing coil itself is driven by a so-called constant current amplifier which is free from any current distortion irrespective of loading, the force generated by the driving assembly can be completely freed from the harmonic distortion, thus making it possible to provide a much more accurate velocity detection.

Figure 16:
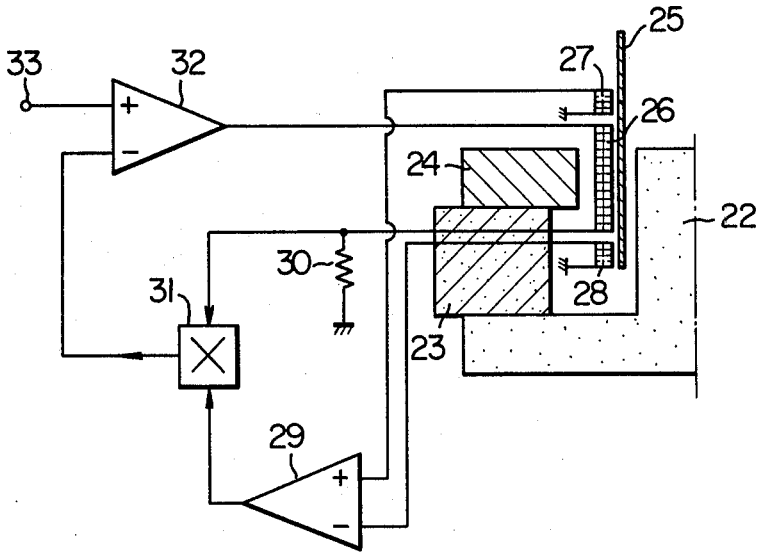
FIG. 16 is a diagrammatic representation, partly in section, showing a further embodiment of the invention.

Apart from reducing the distortion of driving force F by means of the feedback coil as in any of the foregoing embodiments of FIGS. 1 to 9, the distortion of driving force F may be reduced with an arrangement as shown in FIG. 16.

The arrangement of FIG. 16 comprises a pole piece 22, a magnet 23, a plate 24, a bobbin 25, a main coil 26, upper and lower magnetic flux sensing coils 27 and 28, an amplifier 29 for amplifying the difference in current or voltage between the upper and lower magnetic sensing coils 27 and 28, a resistor 30, a multiplier 31, an amplifier 32 for driving the main coil 26, and a signal input terminal 33.

With a current I flowing through the main coil 26, a voltage in proportion to the current I develops across the resistor 30. When a voltage from the amplifier 29 which is proportional to a change Δ(Bl) in the (Bl) force factor and the voltage drop across resistor 30 which is proportional to the current I are applied to a multiplier 31, the multiplier 31 delivers an output voltage which is proportional to Δ(Bl) ×I.

On the other hand, the driving force F for the main coil 26 is $$F=(Bl)\times I \tag{32}$$

and then the distortion component ΔF of the driving force becomes $$\Delta F=\Delta(Bl)\times I_o+(Bl)_o\times\Delta I \tag{33}$$

where ΔI represents the distortion component of the current in the main coil 26.

If the main coil 26 is driven by a current amplifier 32, I is given by the equation, $$I=\frac{G}{1+kRG\Delta(Bl)}\cdot ei \tag{34}$$

where G is the gain of the current amplifier 32, that is to say, output current value |I| when unit potential is supplied to the amplifier 32, and k is the gain of the multiplier 31.

If the value of kRG is adjusted equal to l(Bl), equation (34) becomes as follows if Δ(Bl)/(Bl)<<1, $$I=\frac{Gei}{1+\frac{\Delta(Bl)}{(Bl)_o}}\approx\left\{1-\frac{\Delta(Bl)}{(Bl)_o}\right\}\cdot Gei \tag{35}$$

Then, $$\Delta I=-\frac{\Delta(Bl)}{(Bl)_o}\cdot Gei \tag{36}$$

By combining equation (36) with equation (33), ΔF becomes $$\Delta F=\Delta(Bl)I_o-\Delta(Bl)Gei=0 \tag{37}$$

because $I_o=Gei$.

Although the effect of this embodiment depends on the accuracy of the multiplier 31, a slightly inferior multiplier accuracy is not serious because only the distortion component of the driving force is fedback, and an accuracy of about 10% is satisfactory for practical purposes.

While, in the embodiment of FIG. 16, the error component ΔF of the driving force F is fedback to the input of the amplifier 32 for driving the main coil, a signal (Bl)×I representative of the product of the (Bl) force factor and the current I in the main coil 26 may be fedback directly to the amplifier 32, thus attaining the same effect. In any case, this embodiment dispenses with the feedback coil and suffices a low power amplifier 29 is sufficient. This permits it to be produced at a lower cost than the embodiment of FIG. 1.

What we claim is:

1. In a transducer of the type wherein a bobbin about which a main coil is wound is movably mounted between a pole piece and a plate and the inter-conversion is effected from the current flowing through the main coil to the movement of the bobbin or vice versa, the improvement which comprises upper and lower magnetic flux sensing coils for detecting magnetic flux across the upper and lower end surfaces of said main coil, respectively, a feedback coil, said sensing coils and feedback coil being disposed in a magnetic circuit comprises of said pole piece, plate and main coil, and means for applying a difference between induced electromotive forces or output currents induced thereby in said upper and lower magnetic flux sensing coils to said feedback coil through an amplifier.

2. A transducer according to claim 1, wherein said upper and lower magnetic flux sensing coils are disposed in intimate contact with the upper and lower end surfaces of said main coil, respectively.

3. A transducer according to claim 1, wherein said upper and lower magnetic flux sensing coils are mounted on said pole piece to oppose the upper and lower ends of said main coil, respectively.

4. A transducer according to claim 1, wherein said upper and lower magnetic flux sensing coils are mounted on said plate to oppose the upper and lower ends of said main coil, respectively.

5. A transducer according to claim 1, wherein said upper and lower magnetic flux sensing coils have windings of the same number of turns and are connected in the opposite polarity relationship so that a difference signal between these sensing coils is picked up.

6. A transducer according to claim 1, wherein said feedback coil is disposed on at least one of the upper and lower sides of said plate.

7. A transducer according to claim 1, wherein said feedback coil is disposed immediately above a base portion of said pole piece.

8. A transducer according to claim 1, wherein said main coil is driven by a constant current amplifier.

9. A transducer according to claim 1, wherein said bobbin is mounted with a diaphragm which vibrates in response to the movement of said bobbin, whereby the transducer acts as a loudspeaker.

10. A transducer according to claim 9, wherein said main coil is driven by a constant current amplifier.

11. A transducer according to claim 1, wherein a compensating coil is disposed in the magnetic circuit and a difference between the output voltages of said main coil and said compensating coil is picked up, whereby the transducer acts, based on the difference in output voltage, as a velocity sensor for detecting the moving velocity of said bobbin.

12. A transducer according to claim 11, wherein windings of said compensating coil and main coil have the same width and said compensating coil opposes said main coil.

13. A transducer according to claim 11, wherein an annular recess is formed in the outer periphery of said pole piece and the winding of said compensating coil is received in the recess.

14. In a transducer of the type wherein a bobbin about which a main coil is wound is movably mounted between a pole piece and a plate and the inter-conversion is effected from the current flowing through the main coil to the movement of the bobbin or vice versa, the improvement which comprises upper and lower magnetic flux sensing coils for detecting magnetic flux across upper and lower end surfaces of said main coil, respectively, said sensing coils being disposed in a magnetic circuit comprised of said pole piece, plate and main coil, first detecting means for detecting a first voltage corresponding to a difference between the output voltages of said upper and lower magnetic flux sensing coils, second detecting means for detecting a second voltage in proportion to the current flowing through said main coil, a multiplier for multiplying the first and second voltages, and means for feeding back the output of the multiplier to the input of an amplifier adapted to drive said main coil.

* * * * *